US006099266A

United States Patent [19]

Johnson et al.

[11] Patent Number: 6,099,266

[45] Date of Patent: Aug. 8, 2000

[54] AIR PUMP

[75] Inventors: Lonnie G. Johnson, Smyrna; Shane Matthews, Marietta, both of Ga.

[73] Assignee: Johnson Research & Development Company, Inc., Smyrna, Ga.

[21] Appl. No.: 09/205,219

[22] Filed: Dec. 4, 1998

[51] Int. Cl.[7] ..... F04B 19/00; F04F 5/44

[52] U.S. Cl. ..... 417/313; 417/152; 417/181

[58] Field of Search ..... 417/313, 152, 417/181

[56] References Cited

U.S. PATENT DOCUMENTS

| | | | |
|---|---|---|---|
| 1,005,288 | 10/1911 | O'leary | 417/181 |
| 1,658,797 | 2/1928 | Charette | 417/181 |
| 1,661,002 | 2/1928 | McClymont et al. | 417/181 |
| 1,968,716 | 7/1934 | Smith | 417/181 |
| 5,478,209 | 12/1995 | McDonough | 417/174 |

*Primary Examiner*—Teresa Walberg
*Assistant Examiner*—Vinod D. Patel
*Attorney, Agent, or Firm*—Kennedy, Davis & Hodge, LLP

[57] ABSTRACT

An air pump (10) having a separation chamber (15) defined by a top wall (11), a bottom wall (12) and generally annular side walls (13). A liquid entry tube (24) configured to draw air into a stream of liquid passing through the liquid entry tube is coupled to the separation chamber so that the air/liquid mixtures rotates within the separation chamber. The rotation of the mixture causes air to accumulate within a central zone (30) and the liquid to accumulate about a peripheral zone (31). The continued flow of the mixture causes the accumulating air to become pressurized where it is released through an air exit tube (20) in fluid communication with the central zone of the separation chamber. The liquid is expelled through a liquid exit port (18).

18 Claims, 1 Drawing Sheet

AIR PUMP

TECHNICAL FIELD

This invention relates to air pumps.

BACKGROUND OF THE INVENTION

Pumps which are used to pressurize air have exited from centuries. Today's air pumps typically include a cylinder in which a piston is reciprocally mounted so that air is drawn into the cylinder as the piston is moved in one direction and the drawn air is expelled under pressure as the piston is moved in the opposite direction. These air pumps have included both pistons which are manually actuated and pistons which are mechanically actuated through the use of gas powered engines or electric motors. In some locations, however, a source of electric power is not readily available and a motorized source is inconvenient.

Another problem with these air pumps is related to the seal between the piston and cylinder necessary to pressurize the air. These seals often wear due to the friction imposed upon them during piston movement. This wearing of the seal eventually causes an incomplete seal which in turn causes the pump to become inefficient or even inoperable.

Small air pumps, commonly associated with the inflation of floats and inflatable toys, have been designed which do not include pistons. These air pumps typically include a resilient bladder coupled to an air hose. The operator merely compresses the bladder to cause air to be expelled from the bladder and through the hose. While these air pumps are less suspectable to wear, they typically do not create a large pressure differential and do not pressurize large volumes of air with each stroke. Additionally, between each compression of the bladder the operator must wait for the bladder to re-inflate. As such, a person inflating a large float or the like must operate the pump for an extended period of time to accomplish the task. This has proven to be both time consuming and fatiguing.

It thus is seen that there remains a need for a non-manual air pump which does not require mechanical or electrical motors to operate. Accordingly, it is to the provision of such that the present invention is primarily directed.

SUMMARY OF THE INVENTION

In a preferred form of the invention an air pump comprises a separation chamber having generally annular side walls about an upright central axis. The separation chamber has a liquid exit port, a liquid entry tube having a passage extending into the separation chamber at an oblique angle with respect to a radial extending from the chamber central axis for introducing a stream of liquid having air mixed therein into the separation chamber so as to cause the stream to flow about the chamber axis in one direction, and an air exit conduit in fluid communication with a central portion of the separation chamber. With this construction, the rotation of the air entrained liquid about the separation chamber causes the air therein to accumulate within central zone and be expelled under pressure through the air exit conduit.

DETAILED DESCRIPTION

Figure 1:
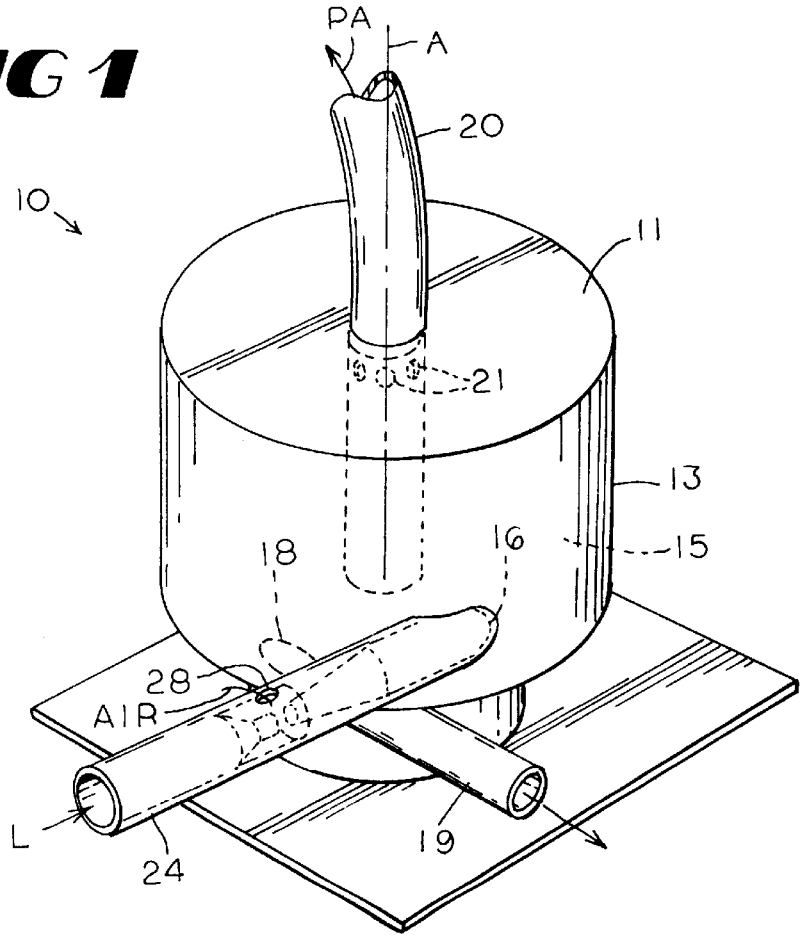
FIG. 1 is a perspective view of an air pump embodying principles of the invention is a preferred form.
Figure 2:
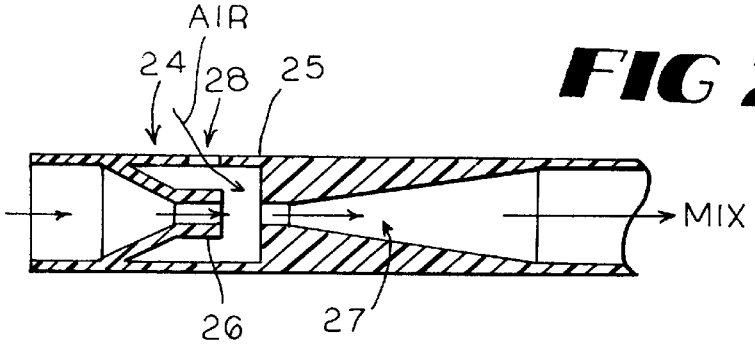
FIG. 2 is a cross-sectional view of the liquid entry tube of the air pump of FIG. 1.

With reference next to the drawings, there is shown an air pump 10 having a top wall 11, a bottom wall 12 and generally annular side walls 13 aligned about a central axis A extending between the top wall 11 and the bottom wall 12. The top wall 11, bottom wall 12 and side walls 13 together define a separation chamber 15. The side walls 13 have a liquid entry port 16 extending at oblique angle with respect to a radial extending from the central axis A. The bottom wall 12 has a liquid exit port 18 positioned adjacent to and immediately upstream of the liquid entry port 16.

A liquid exit tube 19 is mounted to the bottom wall 12 about the liquid exit port 18. An air exit tube 20, generally in alignment with central axis A, extends through the top wall 11 and into the separation chamber 15. The air exit tube 20 has a series of openings 21 extending therethrough positioned within the separation chamber adjacent the top wall 11.

A liquid entry tube 24 is mounted to the side wall 13 about the liquid entry port 16. The liquid entry tube 24 has a tubular housing 24, defining a narrow passage portion or nozzle 26 adjacent and directed to a tapered, wider passage portion 27. The wider passage portion 27 has an air entry opening 28 adjacent its entry.

In use, the liquid entry tube 24 is coupled to a source of pressurized liquid, such as a hose coupled to a municipal water supply. As a liquid stream L flows through the nozzle 26 and into the wider passage portion 27 a low pressure zone is formed at the entrance of the wider passage portion 27, i.e. a venturi effect is created by the flow of the stream. This low pressure zone draws ambient air AIR through the air entry opening 28 wherein the air is entrained or otherwise mixed with the liquid stream within the wider passage portion 27 and the remaining portion of the liquid entry tube 24.

Figure 3:
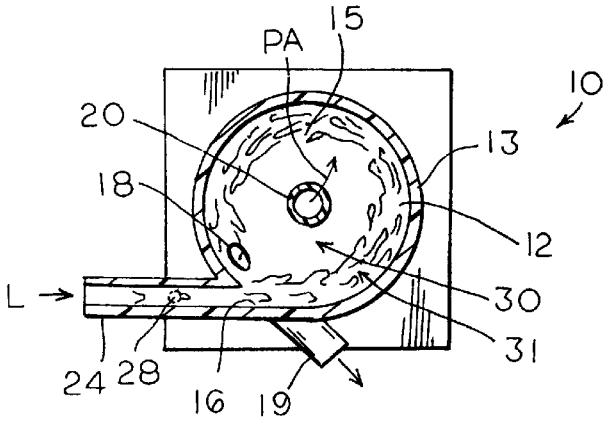
FIG. 3 is a cross-sectional view of the air pump of FIG. 1 shown in an operational mode.

The liquid/air mixture is expelled from the liquid entry tube 24 and into the separation chamber 15, where because of the oblique angle of the liquid entry port 16 and liquid entry tube 24 the mixture rotates within the separation chamber about axis A. The centrifugal force of the mixture about the separation chamber 15 causes the lighter air to move towards the center or central zone 30 of the separation chamber and the heavier liquid to move towards the periphery or peripheral zone 31 of the chamber, as best shown in FIG. 3. A portion of the liquid is then expelled from the separation chamber through the liquid exit port 18. As the mixture continues to be introduced into the separation chamber the quantity of air within the central zone 39 of the separation chamber increases, thereby pressurizing the air within the central zone 30. This pressurized air PA passes into the air exit tube 20 through openings 21, where it then travels through the air exit tube 20 for ultimate use. As such, the air pump may be coupled to a conventional garden hose or faucet with the end of the air exit tube coupled to an inflatable toy to be inflated. With the flow of water through the air pump a constant source of pressurized air is created.

As the just described air pump has no moving parts, such is not susceptible to wear. Furthermore, the pump operates without the use of mechanical or electrical motors and without manual manipulation.

It should be understood that the exact position of the air entry opening 28 may vary somewhat from that shown, so long as it is positioned within a low pressure zone so as to draw air into the liquid stream. Also, other types of conventional air mixing means may be used to entrain or mix the air into the liquid stream. Additionally, it is not necessary for the air pump to include a liquid exit tube and may merely include the liquid exit port. Configured in this manner, the liquid exit port 18 is considered an exit conduit even though such may not extend from the walls which define the separation chamber. However, it should be understood that the preferred embodiment includes a liquid exit tube so that such may be used also as a water hose, as part of a water toy or as drive means for a water toy.

While this invention has been described in detail with particular references to the preferred embodiment thereof, it should be understood that many modifications, additions and deletions, in addition to those expressly recited, may be made thereto without departure from the spirit and scope of the invention as set forth in the following claims.

What is claimed is:

1. An air pump comprising, a separation chamber having generally annular side walls about an upright central axis, said separation chamber having a liquid exit port;

a liquid entry tube having a passage extending into said separation chamber at an oblique angle with respect to a radial extending from said chamber central axis for introducing a stream of liquid having air mixed therein into said separation chamber so as to cause the stream to flow about said chamber axis in one direction;

an air exit conduit in fluid communication with a central portion of said separation chamber, whereby the rotation of the air entrained liquid about the separation chamber causes the air therein to accumulate within central zone and be expelled under pressure through the air exit conduit.

2. The air pump of claim 1 wherein said liquid entry tube has a narrow passage portion extending to a widened passage portion having an air entry opening therein in fluid communication with ambience, whereby the flow of a stream of liquid from said narrow passage portion to said widened passage portion causes a low pressure zone within the widened passage portion which draws air through the air entry opening and into the stream of liquid.

3. The air pump of claim 1 further comprising a liquid conduit coupled to said liquid exit port.

4. The air pump of claim 1 wherein said air exit conduit extends into said separation chamber and said air exit conduit has at least one air intake port adjacent the top of said separation chamber.

5. The air pump of claim 1 wherein said liquid exit port is positioned adjacent said liquid entry tube.

6. The air pump of claim 5 wherein said liquid exit port is positioned upstream of said liquid entry tube with respect to the flow of the stream of liquid within said chamber.

7. The air pump of claim 1 wherein said liquid entry tube extends through said chamber side walls.

8. An air pump comprising, a separation chamber having generally annular peripheral side walls about an upright central axis, said separation chamber having a liquid exit port adjacent the periphery of said chamber, a liquid entry port adjacent the periphery of said chamber configured to direct a flow into said separation chamber at an oblique angle with respect to a radial extending from said chamber central axis, and an air exit port positioned generally along a central portion of said chamber;

a liquid entry tube in fluid communication with said liquid entry port for introducing a stream of liquid having air entrained therein into said separation chamber through said liquid entry port to cause the stream to flow about said chamber axis in one direction;

an air exit conduit in fluid communication with said air exit port, whereby the rotation of the air entrained liquid about the separation chamber causes the air therein to accumulate within a central portion of the separation chamber and be expelled through the air exit conduit.

9. The air pump of claim 8 wherein said liquid entry tube has a narrow passage portion extending to a widened passage portion having an air entry opening therein in fluid communication with ambience, whereby the flow of a stream of liquid from said narrow passage portion to said widened passage portion causes a low pressure within the widened passage portion which draws air through the air entry opening and into the stream of liquid.

10. The air pump of claim 8 further comprising a liquid conduit coupled to said liquid exit port.

11. The air pump of claim 8 wherein said air exit conduit extends into said separation chamber and said air exit conduit has at least one air intake port adjacent the top of said separation chamber.

12. The air pump of claim 8 wherein said liquid exit port is positioned adjacent said liquid entry tube.

13. The air pump of claim 12 wherein said liquid exit port is positioned upstream of said liquid entry tube with respect to the flow of the stream of liquid within said chamber.

14. An air pump comprising, first conduit means for introducing a mixture of liquid and air under pressure, separation means for separating the air from the liquid within the mixture and accumulating the separated air, second conduit means for conveying the separated air from said separation means, third conduit means for conveying the separated liquid from said d separation means.

15. The air pump of claim 14 wherein said separation means comprises a separation chamber having generally annular peripheral side walls about an upright central axis, said separation chamber having a liquid exit port adjacent the periphery of said chamber in fluid communication with said third conduit means, a liquid entry port in fluid communication with said first conduit means and adjacent the periphery of said chamber configured to direct a flow into said separation chamber at an oblique angle with respect to a radial extending from said chamber central axis, and an air exit port in fluid communication with said second conduit means and positioned generally along a central portion of said chamber.

16. The air pump of claim 15 wherein said first conduit means comprises a liquid entry tube having a narrow passage portion extending to a widened passage portion having an air entry opening therein in fluid communication with ambience, whereby the flow of a stream of liquid from said narrow passage portion to said widened passage portion causes a low pressure within the widened passage portion which draws a air through the air entry opening and into the stream of liquid.

17. The air pump of claim 14 wherein said first conduit means includes a liquid passage therethrough and air introduction means for introducing a flow of air into a stream of liquid passing through said liquid passage.

18. The air pump of claim 17 wherein said air introduction means comprises a narrow passage portion within said liquid passage extending to a widened passage portion within said liquid passage having an air entry opening therein in fluid communication with ambience, whereby the flow of a stream of liquid from said narrow passage portion to said widened passage portion causes a low pressure zone within the widened passage portion which draws air through the air entry opening and into the stream of liquid.

* * * * *